US005708405A

United States Patent [19]

Moriyama et al.

[11] Patent Number: 5,708,405

[45] Date of Patent: Jan. 13, 1998

[54] SUPERCONDUCTING COIL AND MANUFACTURING METHOD THEREOF

[75] Inventors: Hideshige Moriyama, Yokohama; Hiroki Sekiya, Kawasaki; Tamiko Hirumachi, Tokyo-to; Hisayasu Mitsui, Yokohama; Susumu Mine, Zushi; Takahiro Tsuchihashi, Yokohama; Akio Tanaka, Yokohama; Sei Murai, Yokohama; Takayuki Kobayashi, Yokohama; Hiroshi Hatano, Yokohama, all of Japan

[73] Assignee: Kabushiki Kaisha Toshiba, Kawasaki, Japan

[21] Appl. No.: 538,938

[22] Filed: Oct. 4, 1995

[30] Foreign Application Priority Data

Oct. 4, 1994 [JP] Japan ..... 6-239936
Oct. 21, 1994 [JP] Japan ..... 6-257045

[51] Int. Cl.[6] ..... H01F 5/02; H01F 5/06; H01F 5/08

[52] U.S. Cl. ..... 335/216; 505/705; 505/879

[58] Field of Search ..... 335/216; 336/DIG. 1; 505/211, 705, 879

[56] References Cited

FOREIGN PATENT DOCUMENTS

| | | |
|---|---|---|
| 2-24005 | 5/1990 | Japan . |
| 142707 | 5/1992 | Japan . |
| 2 131 620 | 6/1984 | United Kingdom . |
| 2 196 481 | 4/1988 | United Kingdom . |

OTHER PUBLICATIONS

Excerpt of US 4195607.

*Primary Examiner*—Cassandra C. Spyrou
*Assistant Examiner*—Raymond Barrera
*Attorney, Agent, or Firm*—Foley & Lardner

[57] ABSTRACT

A superconducting coil bas a winding wire portion which is formed by winding a superconducting wire covered with an insulating material around a winding frame composed of such a material that its modulus of longitudinal elasticity is 50 (GPa) or greater, and its thermal contraction rate between a room temperature and a temperature of 77 (K) is 0.35% or above while applying a tensile force thereto, and a bonding material impregnated between the superconducting wires and is then solidified by a heat treatment to reduce a contact surface pressure between the winding wire portion and the winding frame, preventing transition to a normal conductive state.

A method for manufacturing superconducting coil having a step of forming a winding wire portion by winding a winding frame with insulation superconducting wires in a plurality of lines and in a plurality of layers while applying a tensile force thereto, the method includes a step of setting a winding tensile force of the insulation superconducting wires larger in intermediate through external layers apart from the winding frame than in an internal layer close to the winding frame or a step of forming a non-acute angled cavity between the curved surfaces to restrain the occurrences of a crack and the exfoliation of the winding wire portion and generation of quench due to the electromagnetic force when exciting the coil.

6 Claims, 10 Drawing Sheets

SUPERCONDUCTING COIL AND MANUFACTURING METHOD THEREOF

BACKGROUND OF THE INVENTION

1. Field of the invention

The present invention relates generally to a superconducting coil for use with a nuclear fusion equipment, a magnetic resonance imaging apparatus, a magnetic levitation system train, etc. The present invention relates more particularly to a superconducting coil constructed to restrain a transition to a normal conductive state by reducing a frictional heat under an electrified and to a manufacturing method thereof.

2. Description of the Background Art

Generally known is a superconducting coil including a winding portion formed by winding a superconducting wire on an outer periphery of a metallic winding frame (Japanese Patent Publication No. 63-62084(1988)). A structure of this conventional superconducting coil will be hereinafter explained with reference to FIG. 1.

FIG. 1 illustrates a conventional superconducting solenoid coil with some portions cut away. Referring to FIG. 1, the superconducting coil 1 has a winding frame 2 wound with the superconducting wire 4. This winding frame 2 is constructed of a cylindrical winding frame drum 2*a* and annular winding frame collars 2*b* provided at both edges thereof.

A drum insulation-to-earth material 3*a* and a collar insulation-to-earth material 3*b* are covered on the outer periphery of the winding frame 2, i.e., the outer peripheral surface of the winding frame drum 2*a* and face-to-face surfaces of the winding frame collars 2*b*. A wire winding portion 4 composed of the superconducting wires wound in a plurality of lines and in a plurality of layers is formed on the outer periphery of the winding frame 2 through this insulation-to-earth material 3.

The winding frame 2 is composed of aluminum or an aluminum alloy, Polytetrafluoroethylene film (not shown) exhibiting a small coefficient of friction may be disposed between the winding frame 2 and the winding wire portion 4 in some cases. Further, the winding frame 2 may be composed of a material such as stainless steel, etc., and an epoxy resin impregnates the winding wire portion 4 to bond the winding wires in some cases.

In the above conventional superconducting coil, however, it happens that the winding frame and the winding wire portion make frictions with each other during the superconductive state, resulting in a transition to the normal conductive state due the frictional heat therebetween.

Under such circumstances, some of the conventional superconducting coils involve the use of a frictional heat restraining material exhibiting a small coefficient of friction and provided between the winding frame and the winding wire portion. When the contact surface pressure between the winding frame and the winding wire portion is high, it is impossible to sufficiently restrain the transition to the normal conductive state due to the frictional heat because of an increased frictional force.

Another known superconducting coil may be a so-called fusion superconducting coil. This known fusion superconducting coil will be described with reference to FIGS. 1 through 3.

A partial section of the known fusion superconducting coil is as illustrated in FIG. 1.

FIG. 2 is a view illustrating a profile of part of the winding wire portion 4 in FIG. 1. The winding wire portion 4 is constructed in such a way that fusion superconducting wires 6 are wound in a plurality of lines and In a plurality of layers while applying a given tensile force, and, thereafter, a heat treatment is applied thereto. The fusion superconducting wire 6 itself is formed of an insulated superconducting wire 5 and a fusion material 6*a* covered thereon. Further, the adjacent fusion superconducting wires 6 are bonded to each other through the fusion material 6*a*. The insulated superconducting wire 5 is formed of a superconducting wire 5*a* in a substantially straight-angled shape and an insulating material 5*b* covered thereon. Surfaces of the superconducting wire 5*a* at four corners in section are formed as curved surfaces 5*c*. An area between the adjacent curved surfaces 5*c* is substantially filled with the fusion material 6*a* so as not to form a cavity.

FIG. 3 illustrates a section of the fusion superconducting wire 6 before undergoing the heat treatment. As depicted in FIG. 3, at a stage before the heat treatment is applied, the fusion material 6*a* is covered on the entire surface of the insulated superconducting wire 5.

The conventional fusion superconducting coil has such a tendency that an exfoliation between the fusion superconducting wires adjacent to each other is easily caused by an electromagnetic force and a heat stress, and, in addition, a crack due to the heat stress is easy to produce between the curved surfaces 5*c*. Further, The conventional fusion superconducting coil has such a tendency that the friction due to the electromagnetic force and the heat stress is also easy to occur on a contact surface between the winding portion 4 and the drum insulation-to-earth material 3*a*. If the above-described exfoliation, crack and friction occur, an emission of heat ensue in such occurrence areas, and it is anxious to induce quenching critical to the superconducting coil.

SUMMARY OF THE INVENTION

It is a first object of the present invention to provide a method of manufacturing a superconducting coil that is capable of restraining an occurrence of quench by reducing an exothermic quantity concomitant with the above exfoliation, crack and friction.

It is a second object of the present invention to provide a superconducting coil constructed to sufficiently restrain a transition to a normal conductive state by decreasing a contact surface pressure between a winding frame and a winding wire portion.

According to a first aspect of the present invention, there is provided a superconducting coil comprising:

a winding frame composed of such a material that its modulus of longitudinal elasticity is 50 (GPa) or greater, and its thermal contraction rate between a room temperature and a temperature of 77 (K) is 0.35% or above;

a superconducting wire covered with an insulating material; and a winding wire portion formed by winding an outer periphery of said winding frame with said superconducting wire while applying a tensile force thereto, wherein a bonding material impregnates between said superconducting wires and is then solidified by a heat treatment, and a contact surface pressure between said winding wire portion and said winding frame is reduced.

In the superconducting coil of the present invention, after winding the winding frame with the superconducting wire, a heat treatment is effected including the winding frame and the winding wire portion.

The present superconducting coil comprises the winding frame composed of such a material that a modulus of longitudinal elasticity is 50 (GPa) or greater, and thermal contraction rate between a room temperature and a temperature of 77 (K) is 0.35% or above. Therefore, thermal expansion and contraction rates of the winding frame are larger than those of the winding wire portion, end, at a high temperature during the heat treatment, the winding frame expands the winding wire portion outward in a radial direction and shrinks more largely than the winding wire portion when cooled off after the heat treatment.

Due to a differences in terms of the thermal expansion and contraction rates therebetween, the winding wire portion is densely compressed from inside by the winding frame when at the high temperature, and, in this state, a bonding material is hardened. The winding wire portion does not completely revert inward in the radial direction when cooled off. With this operation, a contact surface pressure between the winding frame and the winding wire portion becomes lower than when winding the superconducting wire.

Further, when using this superconducting coil, a temperature of the superconducting coil decreased down to an extremely low temperature. Hence, the winding frame contracts more largely than the winding wire portion, and the contact surface pressure is further reduced, with the result that an evolution of the frictional heat can be well restrained.

The superconducting coil according to the present invention, the winding wire portion is constructed of the winding frame wound with the superconducting wires in the plurality of layers, and the winding tensile force of the external layer area is set larger than in the internal layer area of the winding wire portion, with the result that the winding wire internal layer area is comparatively coarsely wound with the wires. This winding wire internal layer area is densely compressed by the winding frame drum when affecting eh heat treatment at a high temperature, and the inside area of the winding wire portion is easily expanded. It is thereby feasible to obtain the superconducting coil constructed to reduce the contact surface pressure and make the transition to the normal conductive state hard to occur.

The superconducting coil according to the present invention, the maximum temperature for the heat treatment is set higher than the glass transition temperature for the enamel. Hence, the enamel softens during the heat treatment, and the inter layer area of the winding wire portion is compressed densely. It is thus possible to obtain the superconducting coil constructed to reduce the contact surface pressure between the winding frame and the winding wire portion and preventing the transition to the normal conductive state due to the frictional heat.

The superconducting coil according to the present invention is constructed so that the relationship between the thickness d (mm) of the winding frame drum and the winding tensile force F(N) of the winding wire internal area in the vicinity of the winding frame drum is set such as $d>F/10$. Thus, the rigidity of the winding frame drum is relatively enhanced by managing the winding tensile force of the superconducting wire, and it is therefore possible to reduce the initial shrinkage of the winding frame drum when winding the superconducting wire and effectively expand the inside area of the winding wire portion.

The superconducting coil according to the present invention is constructed so that the relationship between the thickness d (m m) and the length L (m m) of the winding frame drum is set such as $d>L/20$. Consequently, the rigidity of the winding frame drum is enhanced, and the initial shrinkage of the winding frame drum when winding the superconducting wire is decreased. It is thereby possible to obtain the superconducting coil constructed to effectively expand the inside area of the winding wire portion when performing the heat treatment and to reduce the contact surface pressure.

In the superconducting coil according to the present invention, the winding frame exhibiting the high rigidity can be obtained because of providing the winding frame drum with the reinforcing member. This makes it feasible to obtain the superconducting coil constructed to decrease the initial shrinkage when winding the superconducting wire, effectively reduce the contact surface pressure between the winding wire portion and the winding frame drum with the heat treatment and thereby make the transition to the normal conductive state due to the frictional heat hard to occur.

The superconducting coil according to the present application includes the winding frame and the winding wire portion which are constructed so that the strain of the winding frame drum when the current rises up to the rated value is set on the order of $20\times10^{-6}$ or under. It is therefore possible to obtain the superconducting coil in which the contact surface pressure between the winding wire portion and the winding frame drum is well reduced at a high probability.

According to a second aspect of the present invention, there is provided a method for manufacturing superconducting coil having a step of forming a winding wire portion by winding a winding frame with insulation superconducting wires in a plurality of line and in a plurality of layers while applying a tensile force thereto, said method comprising:

a step of setting a winding tensile force of the insulation superconducting wires larger in intermediate through external layers apart from said winding frame than in an internal layer close to said winding frame.

According to the present invention, when exciting the superconducting coil, the internal layer of the coil is expanded in the radial direction by the action of the electromagnetic force enough to press the area between the coil layers. Consequently, the large friction and exfoliation between the coil layers are hard to occur, and the generation of the quench can be restrained.

According to the present invention, there is provided further steps of forming at least four-corner surfaces of said fusion superconducting wire is curved surfaces; and of forming a non-acute angled cavity between the curved surfaces.

According to the present invention, the fusion material contiguous to the cavity can be readily shrunk and expanded, and, hence, it is feasible to restrain the occurrences of the crack and the exfoliation of the winding wire portion due to the electromagnetic force when exciting the coil.

According to the present invention, there is provided a method having a step of mounting said winding wire portion in a fastening apparatus;

a step of fastening said winding wire portion in a direction substantially perpendicular to a winding direction of said fusion superconducting wire while applying the heat treatment to said winding wire portion with preventing an inward deformation thereof; and demounting said winding wire portion from fastening apparatus after applying the heat treatment.

According to the present invention, the internal layer of the winding wire portion is expanded in the radial direction and solidified in this as-expanded state, so that the area between the winding wire portion and the winding frame drum is brought into a substantially afloat state. When the superconducting coil is cooled down to an extremely low temperature, the area between the winding wire portion and the winding frame drum comes into a completely afloat state due to the difference in terms of the thermal expansion coefficient therebetween. Hence, the rigidity of the winding wire portion in the axial direction is enhanced, and this can be made to contribute to the restraint of the occurrence of the quench.

According to the present invention, the method for manufacturing superconducting coil further comprises a step of interposing a mold releasing material having a low coefficient of friction between said winding wire portion and said winding frame in advance of forming said winding wire portion by winding said winding frame with said fusion superconducting wires.

This reduces generation of heat from friction or exfoliation to restraint generation of quench, end consequently a large current can be flown with high stability.

According to the present invention, there is provided a superconducting coil manufacturing method comprising:

a step of forming a fusion superconducting wire by coating said insulated superconducting wire with a fusion material;

a step of forming a winding wire portion by winding said winding frame with said fusion superconducting wires in a plurality of lines and in a plurality of layers while applying a tensile force thereto; and bonding adjacent fusion superconducting wires by solidifying said fusion material after melting said fusion material while applying the heat treatment thereto.

According to the present invention, the fusion material is melted when winding the superconducting wire, the insulation superconducting wires directly contact each other at the inter-layer area of the winding wire portion.

It is therefore possible to enhance the rigidity of the winding wire portion in the layerwise, i.e., radial direction, reduce the displacement of the winding wire portion that is concomitant with the heat treatment and make a contribution to the restraint of the occurrence of the quench.

According to the present invention, there is provided a fusion superconducting wire comprising:

an insulated superconducting wire having a superconducting wire having a straight-angled sectional shape covered with an insulating material; and a fusion material having a band- or string-like shape press fitted to a part of surface of the insulated superconducting wire.

According to the present invention, there is provided method for manufacturing fusion superconducting wire which has a step of forming an insulated superconducting wire by coating a superconducting wire having a circular sectional shape with an insulating material; and a thickness of said fusion material on a flat surface serving as part of said insulated superconducting wire being set smaller than a thickness of each of other flat surfaces or set to 0, wherein the method comprises a step of forming an insulating material with a fusion material by combining the insulating material and the fusion material; and a step of forming a fusion superconducting wire by covering the insulating material with fusion material.

There is also provided a method for manufacturing a fusion superconducting wire comprising:

a step of forming an insulated superconducting wire by coating a superconducting wire having a straight-angled sectional shape with an insulating material;

a step of forming a fusion superconducting wire by press-fitting fusion material having a band- or string-line shape to a part of surface of said insulation superconducting wire, wherein said method further comprising a step of forming an insulating material with a fusion material by combining the insulating material and the fusion material; and a step of forming a fusion superconducting wire by covering the insulating material with fusion material.

According to these inventions, it is possible to provide fusion superconducting wire suitable for a superconducting coil which can restrain quench generated by heat due to exfoliation or crack or friction.

BRIEF DESCRIPTION OF THE DRAWINGS

Other objects and advantages of the present invention will become apparent during the following discussion in conjunction with the accompanying drawings, in which.

Figure 2:
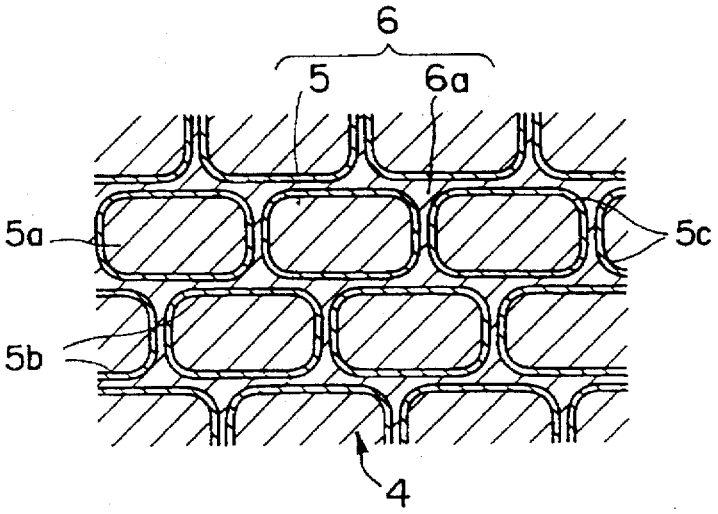
FIG. 2 PRIOR ART
FIG. 2 is a partial sectional view showing a winding wire portion in FIG. 11.
Figure 3:
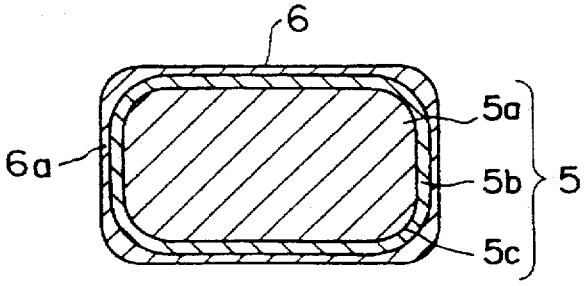
FIG. 3 PRIOR ART
FIG. 3 is a sectional view illustrating a fusion superconducting wire before applying a heat treatment.
Figure 7:
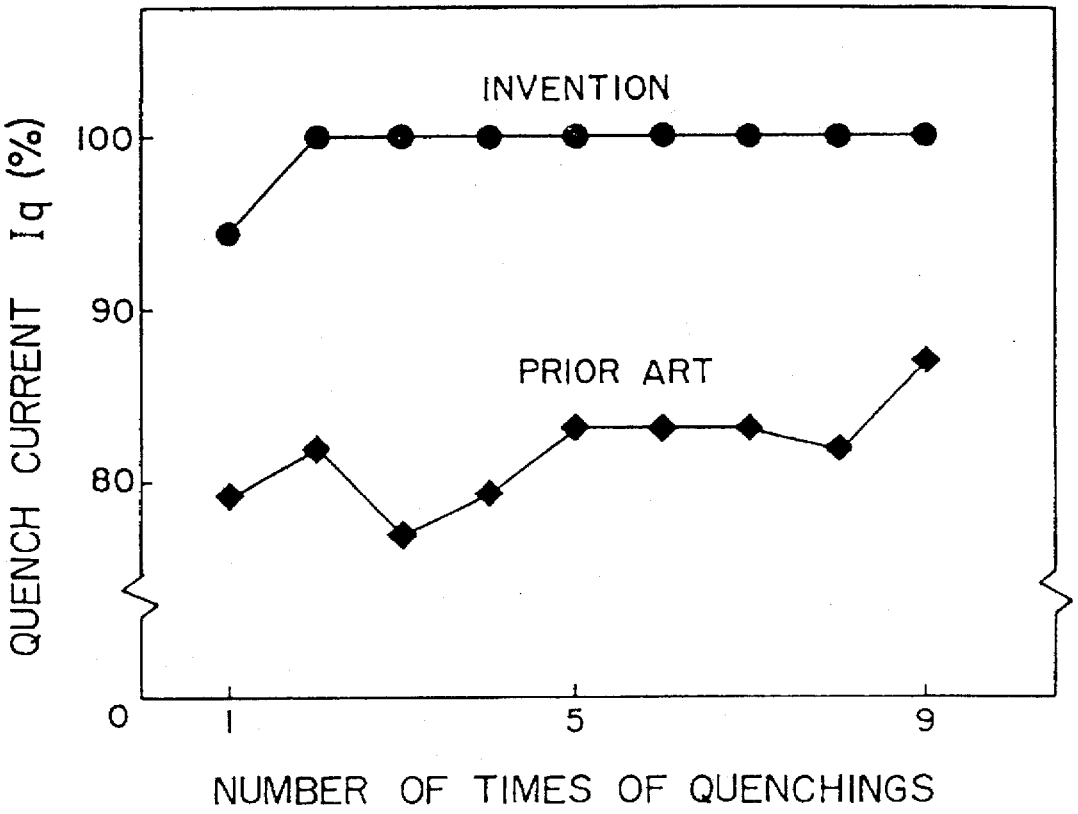
Figure 8:
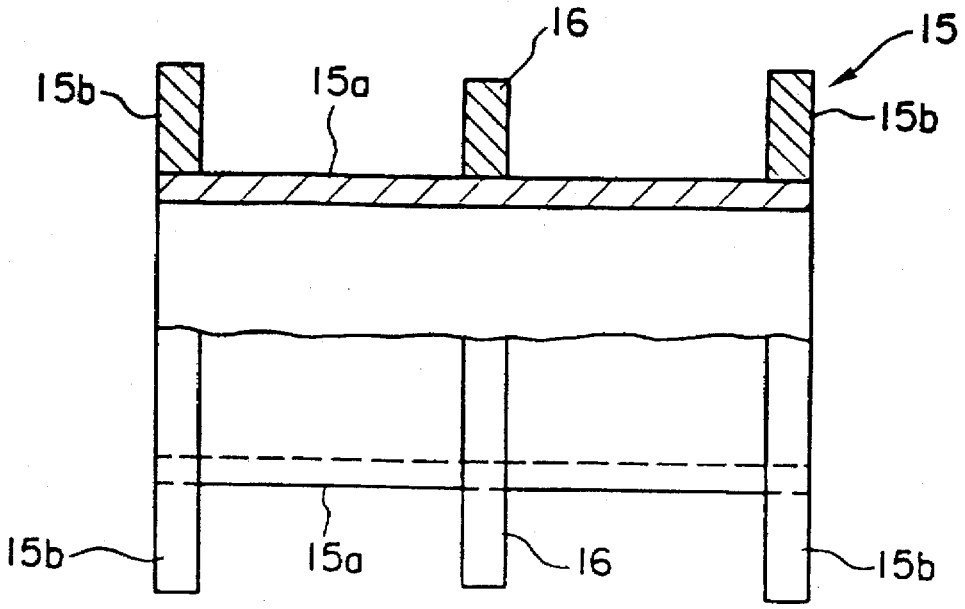
Figure 9:
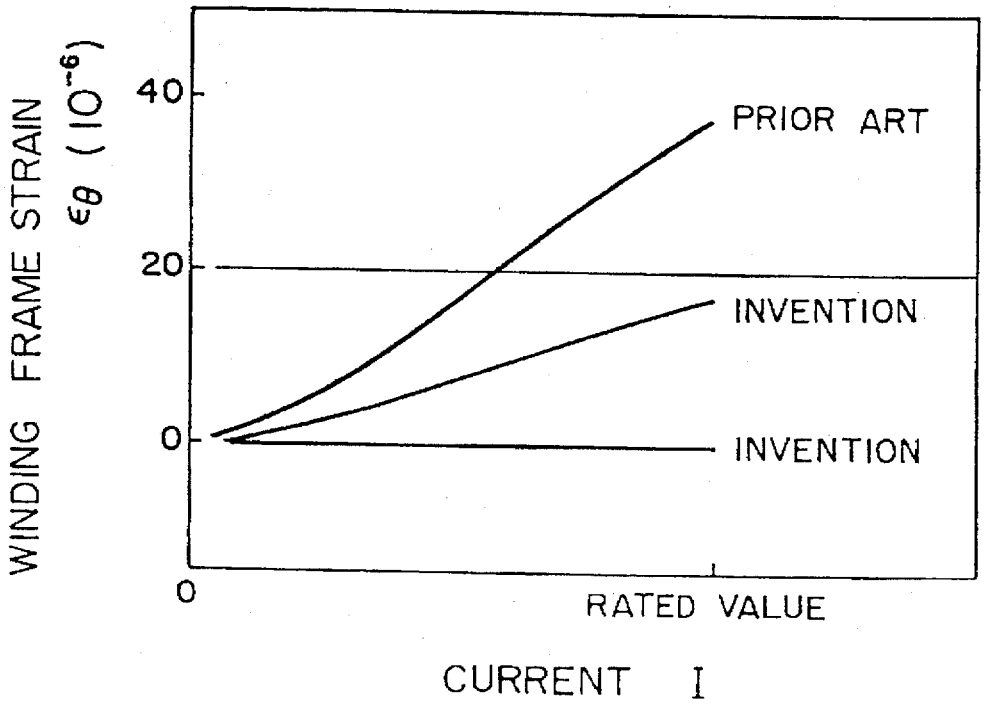
Figure 10:
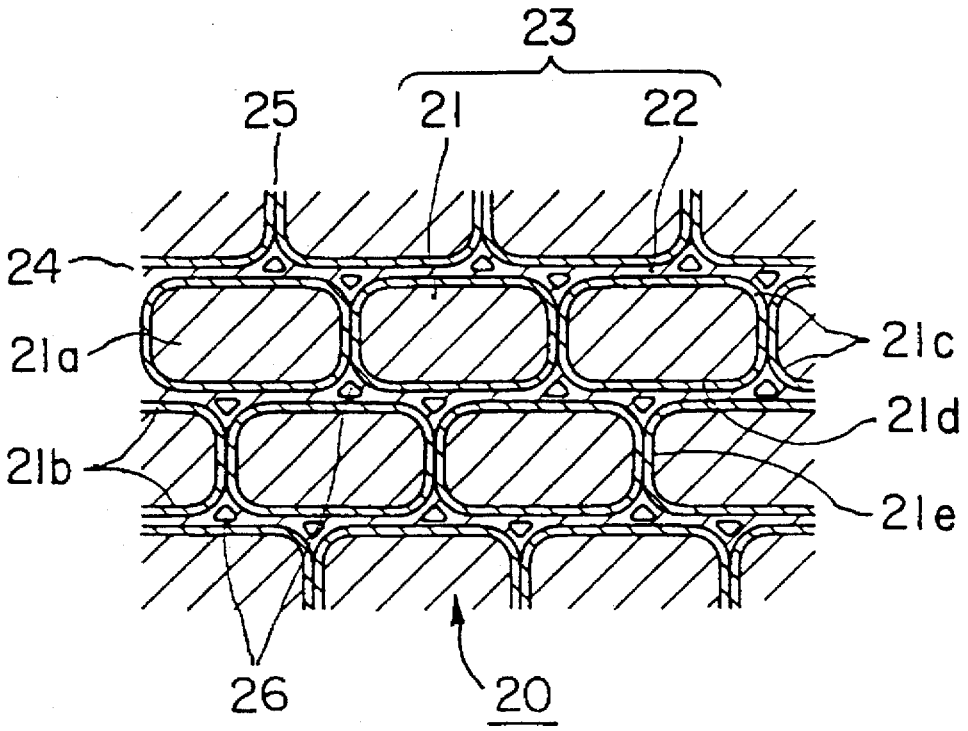
Figure 11:
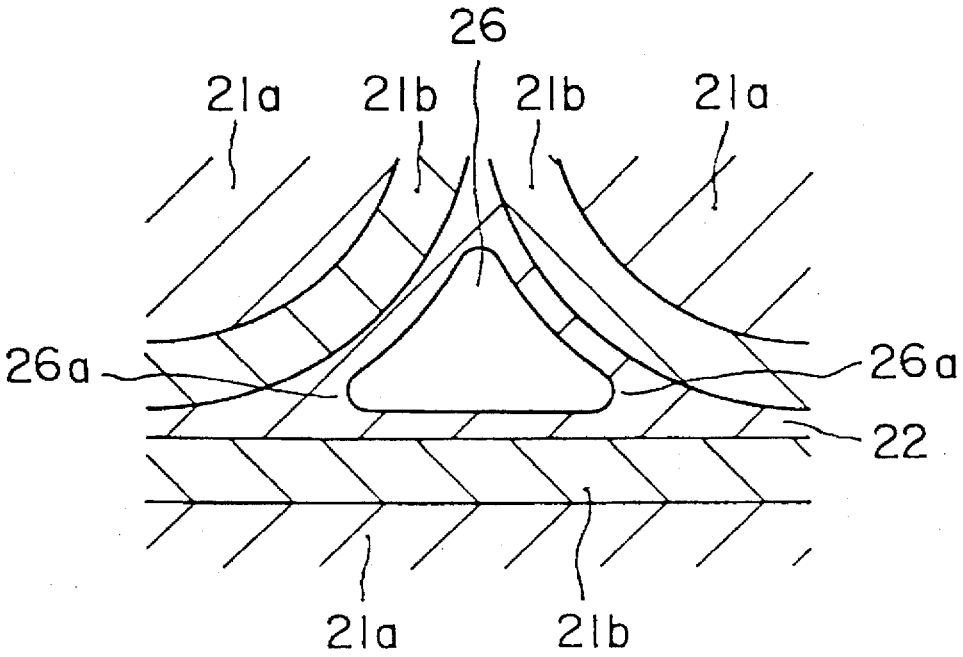
Figure 12:
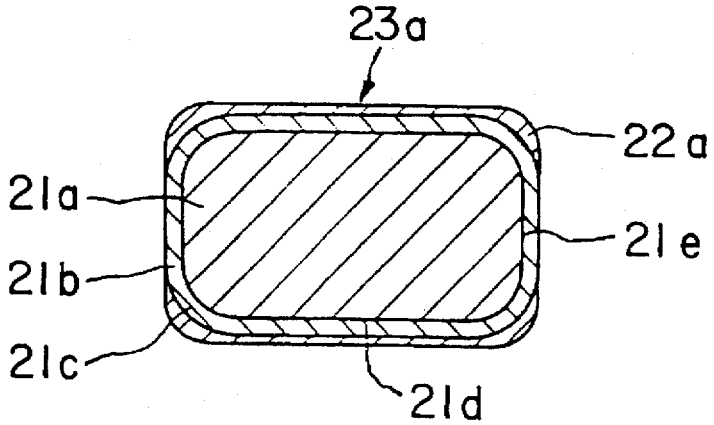
Figure 13:
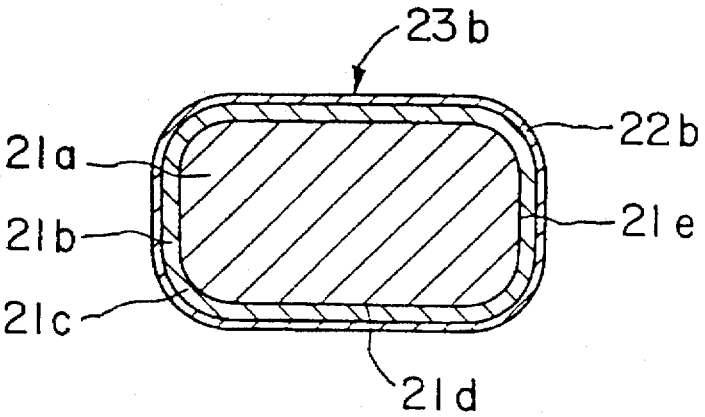
Figure 14:
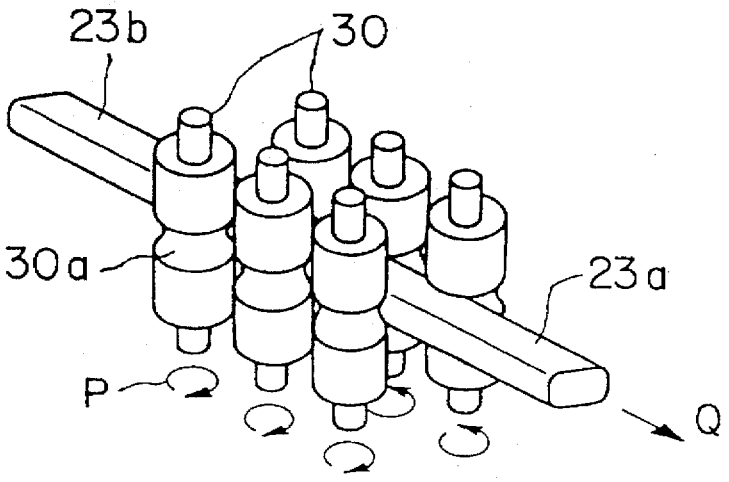
Figure 15:
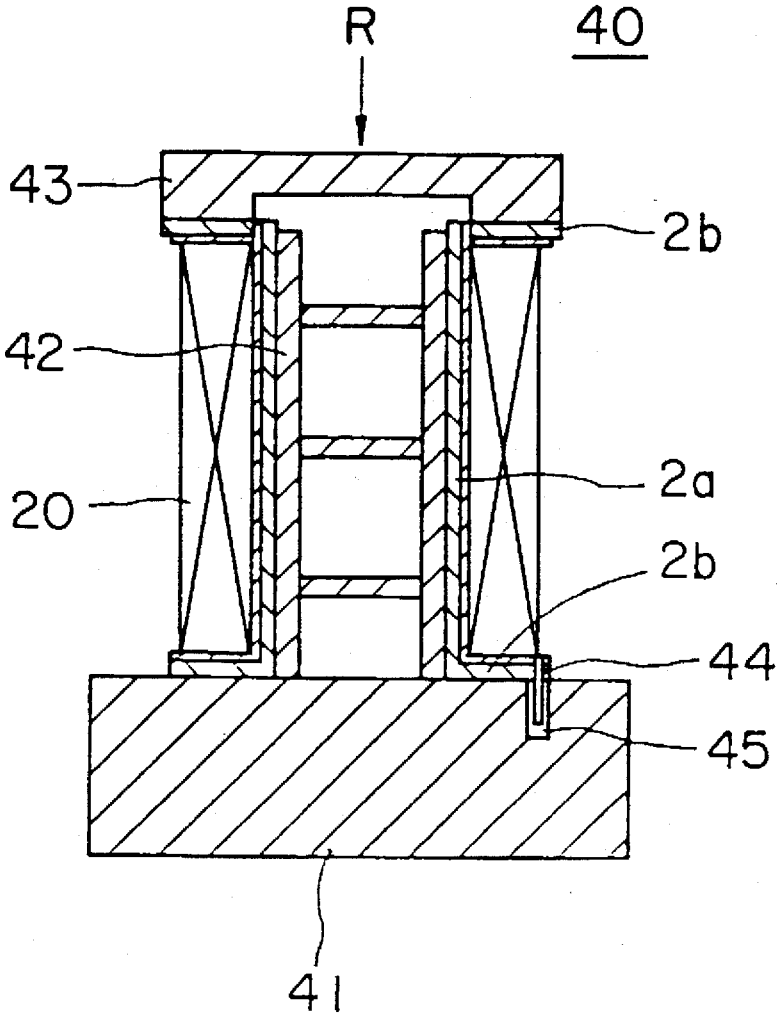
Figure 16:
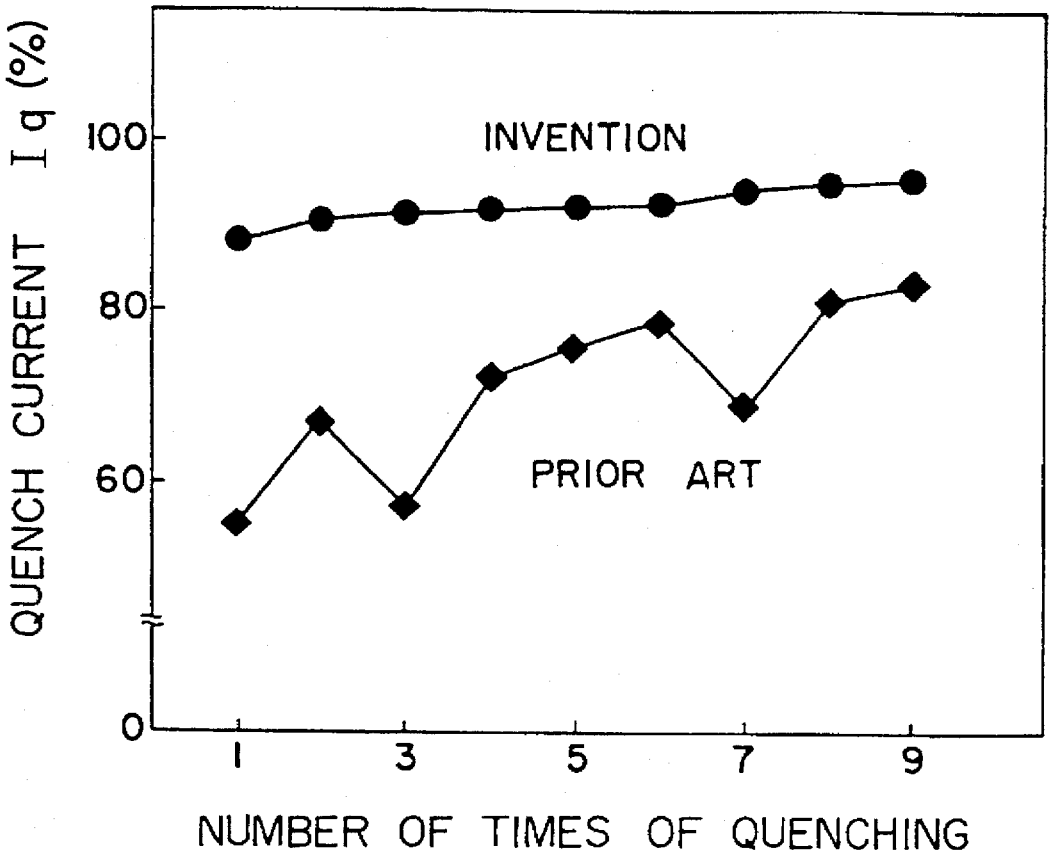
Figure 17:
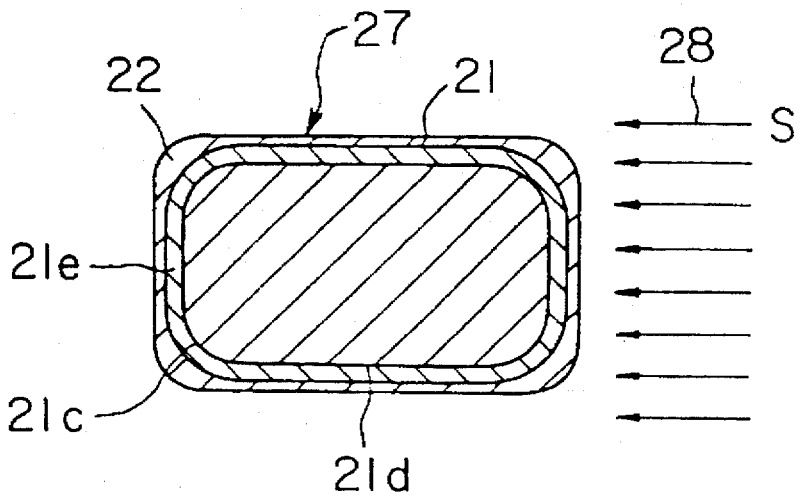
Figure 18:
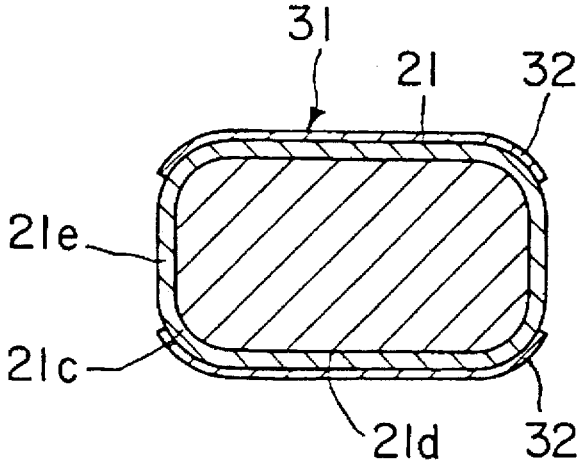
Figure 19:
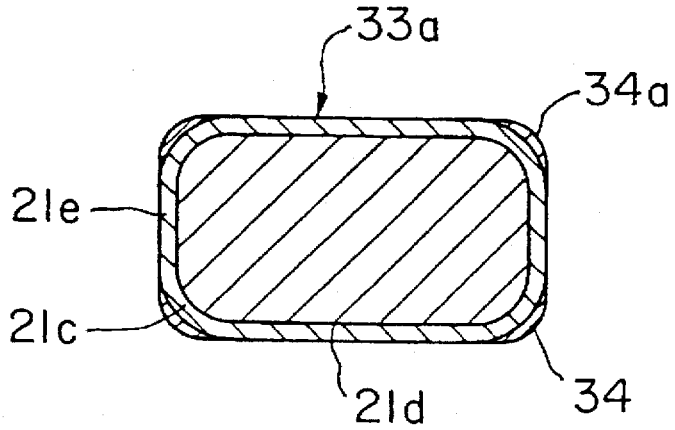
Figure 20:
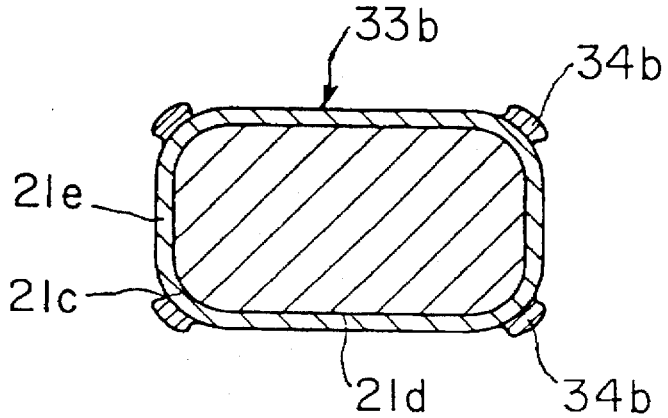
Figure 21:
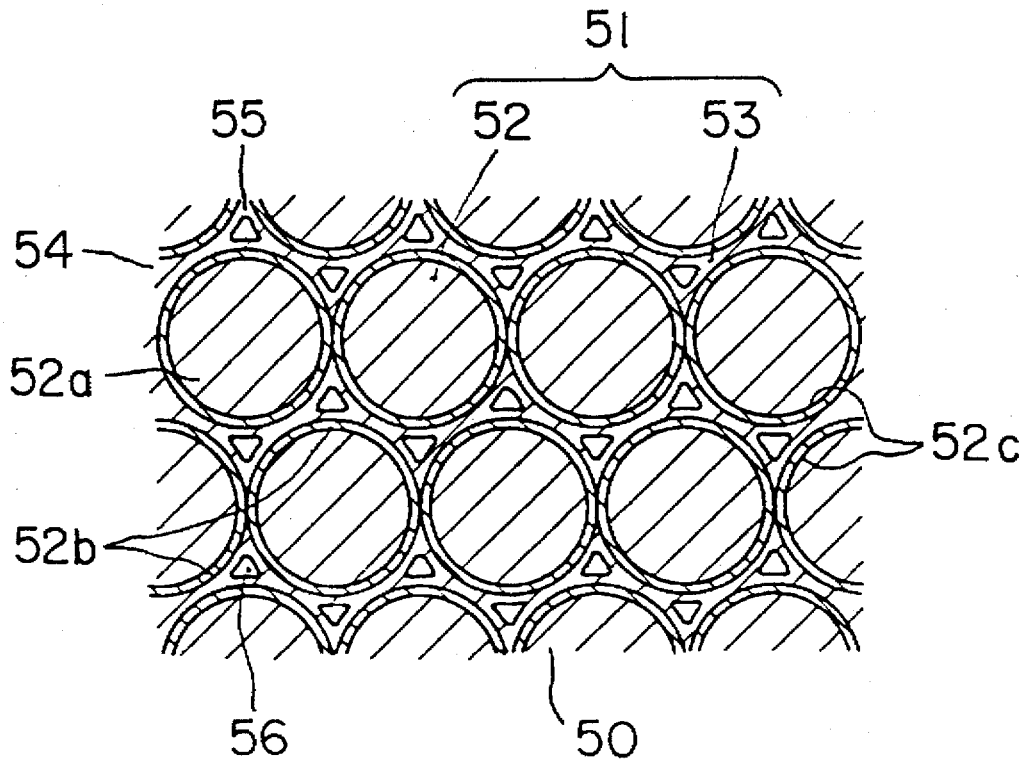
Figure 22:
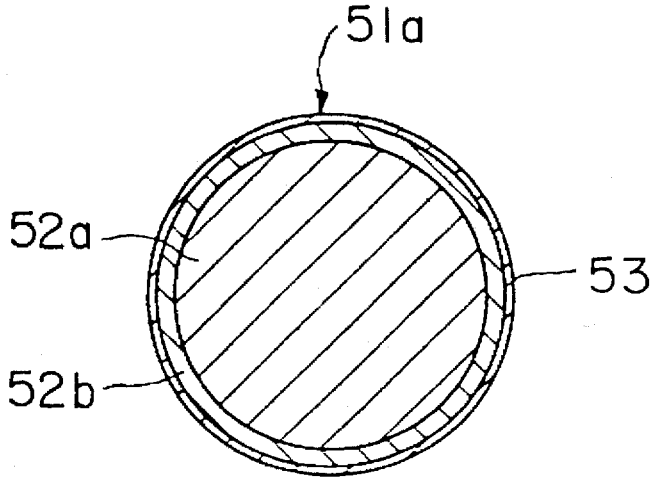

FIGS, 6A and 6B are views of assistance in explaining variations in terms of a contact surface pressure between the winding wire portion and the winding frame drum before and after a heat treatment;

FIG. 7 is a graph showing a comparison in terms of a training characteristic between the superconducting coil of the present invention and a conventional superconducting solenoid coil;

FIG. 8 is a partially cut-away view illustrating the winding frame provided with a reinforcing member in the superconducting coil according to a second embodiment of the present invention;

FIG. 9 is a graph showing a comparison in terms of a strain of the winding frame when electrified between the conventional superconducting solenoid coil and the superconducting coil according to the present invention wherein the strain of the winding frame when a rated current flows is set to a predetermined value or under;

FIG. 10 is a partial sectional view illustrating the winding wire portion in a third embodiment of the present invention;

FIG. 11 is a sectional view showing a cavity and an area in the vicinity thereof in FIG. 10;

PIG, 12 is a sectional view showing a state after forming the fusion superconducting wire illustrated in FIG. 10 but before applying the heat treatment;

FIG. 13 is a sectional view illustrating a state before forming the fusion superconducting wire shown in FIG. 10;

FIG. 14 is a partial perspective view illustrating the fusion superconducting wire shown in FIG. 10 and a forming apparatus thereof;

FIG. 15 is a sectional view illustrating the fusion superconducting coil when effecting the heat treatment and a fastening apparatus thereof;

FIG. 16 is a graph showing a result of measuring a quench current in the two fusion superconducting coils in an embodiment of the present invention that is shown in FIG. 10 end in the prior are shown in FIG. 2;

FIG. 17 is a sectional view illustrating the fusion superconducting wire in a fourth embodiment;

FIG. 18 is a sectional view illustrating the fusion superconducting wire in a fifth embodiment;

FIG. 19 is a sectional view illustrating the fusion superconducting wire in a sixth embodiment;

FIG. 20 is a sectional view showing a state before forming the fusion superconducting wire of FIG. 10;

FIG. 21 is a partial sectional view illustrating the winding wire portion in a seventh embodiment; and FIG. 22 is a sectional view showing the fusion superconducting wire before applying the heat treatment in the winding wire portion of FIG. 12.

DESCRIPTION OF THE PREFERRED EMBODIMENTS

Figure 1:
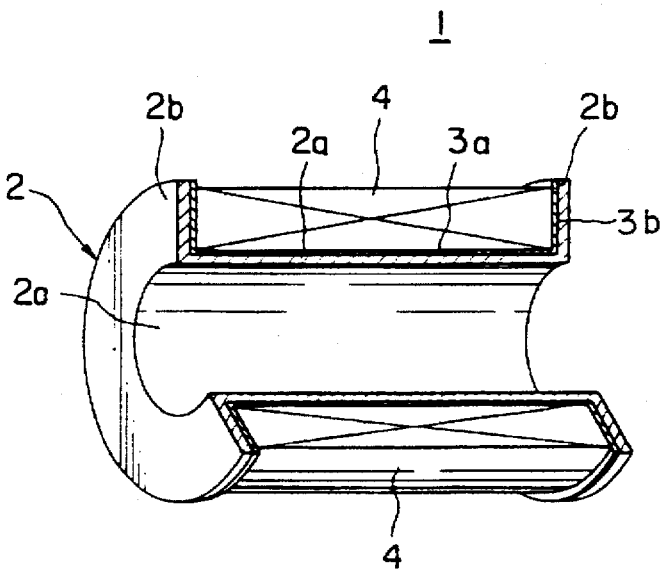
FIG. 1 PRIOR ART
FIG. 1 is a perspective view illustrating a conventional superconducting coil with some portions cutaway.

Illustrative embodiments of the present invention will hereinafter be discussed with reference to the attached drawings. Note that a whole structure of a superconducting coil is the same as the conventional superconducting coil illustrated in FIG. 1 in the following discussion. Hence, the same elements are marked with the same reference numerals, and explanations thereof will be omitted.

(Embodiment 1)

Figure 4:
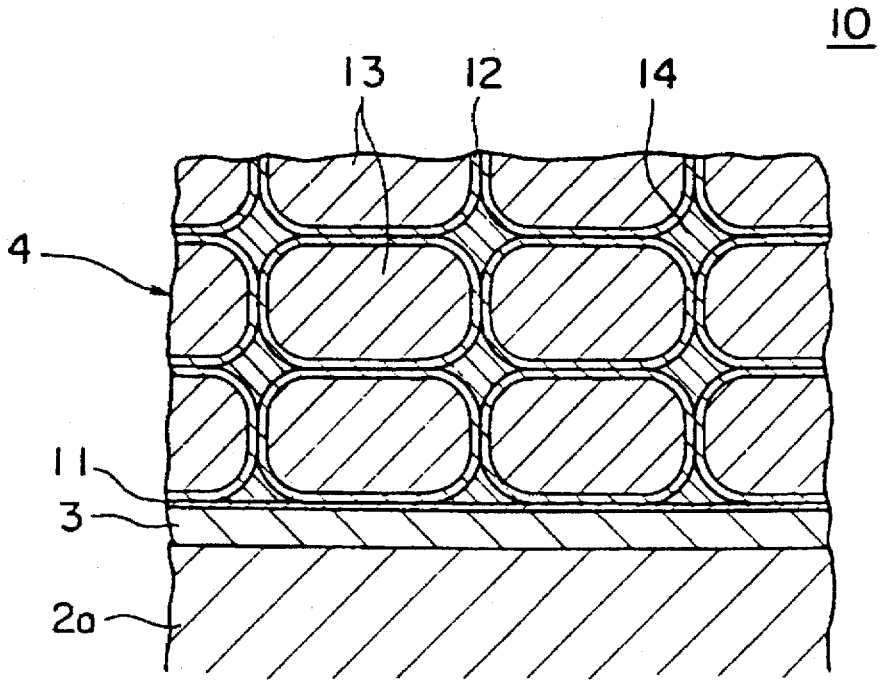
FIG. 4 is an enlarged sectional view illustrating a contact area between the winding frame drum and the winding wire portion of the superconducting coil according to the present invention.

FIG. 4 is a sectional view illustrating an area in the vicinity of a winding frame drum of the superconducting coil in a first embodiment of the present invention.

A superconducting coil 10 in the first embodiment has a winding frame composed of aluminum alloy A5056B (JIS: Japanese Industrial Standard). Aluminum alloy A5056B exhibits such a physical property that a modulus of longitudinal elasticity is on the order of 80 (GPa), and a thermal contraction rate between a room temperature and a temperature of 77 (K) is 0.4%. An outer peripheral surface of a winding frame drum 2a is covered with an insulation-to-earth material 3.

A silicon resin or a fluororesin or paraffin each serving as a frictional heat restraining material 11 and having a mold releasing property is coated 10 μm or small in thickness and hardened on the outside of this insulation-to-earth material 3. The frictional heat restraining material 11 is scraped off strongly with a pallet till the surface thereof after being hardened is leveled or finished by polishing it with a sandpaper or the like. Another kind of frictional heat restraining material 11 may be such a sheet-ilks polytetrafluoroethylene can be adhered to the outside of the insulation-to-earth material 3.

A winding wire portion 4 is formed outwardly of the frictional heat restraining material 11. This winding wire portion 4 is constructed in such a manner that superconducting wires 13 each coated with an enamel 12 are wound on a winding frame 2 in a plurality of lines and in a plurality of layers while applying a tensile force to the superconducting wires 13, and thereafter a bonding resin 14 is impregnated and is hardened between the superconducting wires 13 by a vacuum pressurizing impregnation method.

An enamel coated superconducting wire in the first embodiment has a flat but angular section. The enamel 12 is classified as polyvinylformal having a glass transition temperature of 110° C.–120° C. Further, the bonding resin 14 may be an epoxy resin exhibiting a heat hardening property.

A heat treatment is applied to the superconducting coil 10 after winding the superconducting wires 13. This heat treatment is performed for the purpose of hardening the bonding resin 14 and reducing a contact surface pressure between the winding frame drum 2a and the winding wire portion 4. Effected in the first embodiment is the heat treatment in which the whole superconducting coil 10 is held at a temperature of 80° C. for 15 hours and next held at a temperature of 130° C. for 10 hours.

Further, the winding frame 2 of the superconducting coil 10 in the first embodiment is constructed so that a rigidity thereof increases relatively to a winding tensile force of the wire enough to reduce an initial shrinkage when winding the superconducting wires 13.

Figure 5:
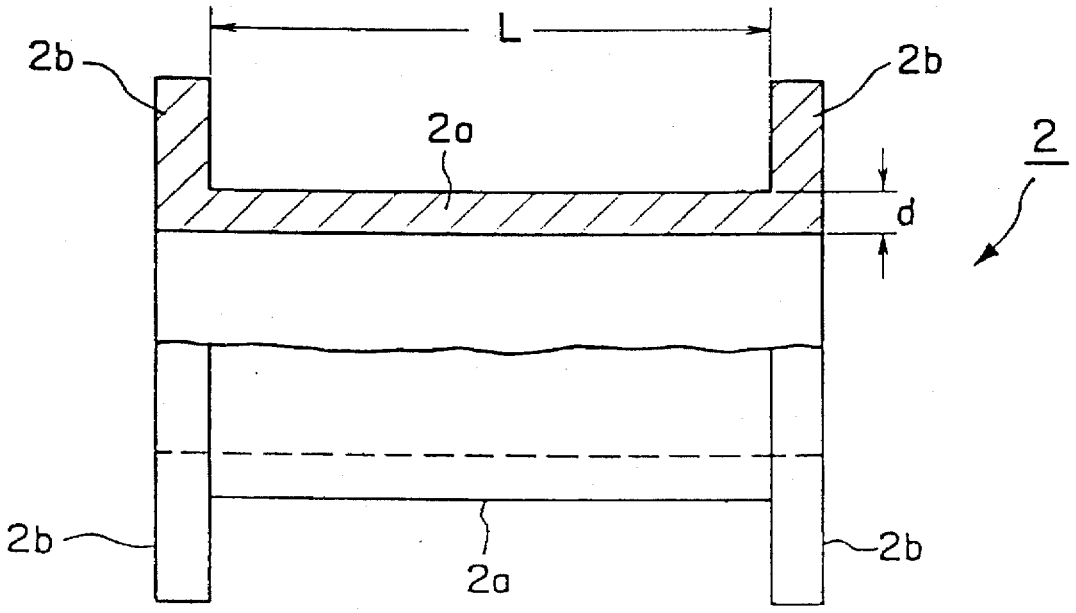
FIG. 5 is a view illustrating only the winding frame with some portions out away in the superconducting coil according to the present invention.

FIG. 5 illustrates only the winding frame 2 of the superconducting coil 10 in this embodiment. This winding frame 2 has a cylindrical winding frame drum 2a and winding frame collars 2b formed in a collar shape at both edges thereof. For enhancing the rigidity, the winding frame drum 2a of the winding frame 2 is set in a relationship such as $d>L/20$, where d is the thickness, and L is the length. More specifically, in this embodiment, the thickness d of the winding frame drum 2a is 10 mm, and the length L is 120 mm.

Further, for enhancing the rigidity of the winding frame 2 with respect to the winding tensile force of the superconducting wire 13, a relationship of the winding tensile force F(N) of the superconducting wire 13 with the thickness d(mm) of the winding frame drum 2a is set such as $d>F/10$ with respect to the winding wire internal layer area. More specifically, the winding tensile force of each of the enamel coated superconducting wires 12, 13 in this embodiment is set to 60 (N) with respect to the winding wire internal layer area occupying substantially one third of the thickness of the winding wire portion 4 in the vicinity of the winding frame drum 2a and set to 90 (N) with respect to a winding wire external layer area occupying two thirds of the thickness of the remaining winding wire portion 4 spaced away from the winding frame drum 3a.

Next, an operation of the superconducting coil 10 in the first embodiment having the construction described above will be explained with reference to FIGS. 6A, 6B and 7.

Figures 6A, 6B:
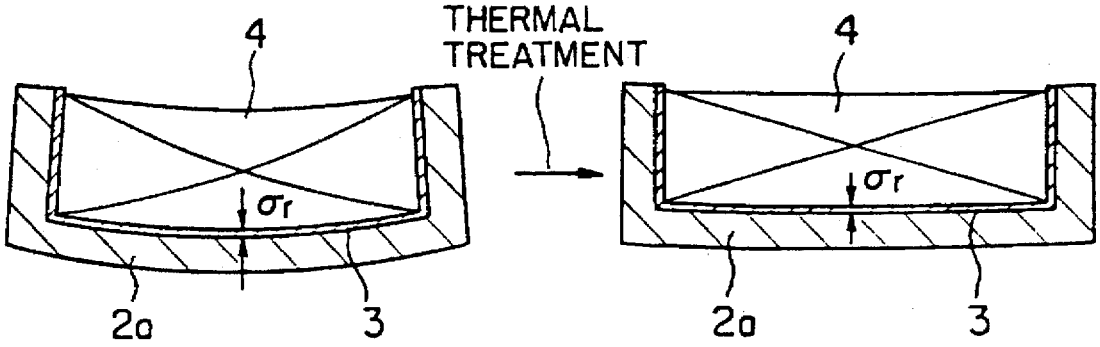

Variations in the superconducting coil 10 before the heat treatment (FIG. 6A) and after the heat treatment FIG. 6B) are seen with respect to part (one side from the central line) of the superconducting coil 10. In this superconducting coil 10, the winding frame 2 is formed of a material having a modulus of longitudinal elasticity on the order of 50 (GPa) or larger; the thickness d of the winding frame drum 2a with respect to the winding tensile force of the winding wire internal layer area is set such as $d>F/10$; and the length n of the winding frame drum 2a with respect to the thickness d of the winding frame drum 2a is set as short as $d>L/20$. The relative rigidity of the winding frame 2 with respect to the winding tensile force F of the superconducting wire 13 is thereby enhanced. For this reason, there is no possibility in which the winding frame drum 2a largely contracts inward in the radial direction when winding the superconducting wire 13.

Further, the winding frame 2 is formed of such a material that its thermal contraction rate between the room temperature end the temperature of 77 (K) is 0.35% or larger, and, therefore, its thermal expansion and contraction rates become larger than in the winding wire portion 4. Hence, during the heat treatment at the temperature 80° C., the contracted winding frame drum 2*a* expands the winding wire portion 4 outward in the radial direction through the insulation-to-earth material 3. Further, since the winding tensile force F of the superconducting wire 13 of the winding wire internal layer area of the winding wire portion 4 is set small, the winding wire internal layer area wound coarsely with the superconducting wires before the heat treatment is densely compressed from inside by the winding frame drum 2*a*, resulting in such a state that the central portion is expanded. Meanwhile, the hardening reaction of the bonding resin 14 advances.

Next, for the duration of performing the heat treatment at a temperature 130° C., the winding frame drum 2*a* further expands the winding wire portion 4 outward in the radial direction. At this time, the heat treatment temperature (130° C.) exceeds a glass transition temperature (110° C. through 120° C.) of the enamel, and therefore the enamel 12 softens and deforms by the winding tensile force F of the superconducting wire 13, with the result that the inter layer area of the winding wire portion 4 is densified. Meanwhile, the hardening reaction of the bonding resin 14 terminates.

When returning the superconducting coil 10 to the room temperature after finishing the heat treatment, the internal layer area of the winding wire portion 4 remains densely compressed but does not completely revert inward in the radial direction. For this reason, as illustrated in FIB. 6A, a contact surface pressure or between the winding frame drum 2*a* and the winding wire portion 4, which was large before the heat treatment as shown in FIG. 6A, decreases as illustrated in FIG. 6B.

Moreover, in case the temperature of the superconducting coal 10 in use decreases down to an extremely low temperature, the winding frame 2 contracts more largely than the winding wire portion 4, and there is developed a state as if an area between the winding wire portion 4 and the winding frame drum 2*a* is afloat, with result that the contact surface pressure $\sigma$ becomes substantially zero. This prevents an emission of the frictional heat between the winding wire portion 4 and the winding frame drum 2*a* enough to restrain the transition to the normal conductive state.

FIG. 7 shows a training characteristic of the superconducting coil 10 versus a training characteristic of the conventional superconducting solenoid coil. As obvious from FIG. 7, the superconducting coil according to this invention is stabilized with a higher quench current than in the superconducting solenoid coil in the prior art.

(Embodiment 2)

FIG. 8 is a sectional view illustrating the winding frame of the superconducting coil with some portions cut away in a second embodiment of the present invention. This winding frame 15 is constructed of a cylindrical winding frame drum 15*a* and collar-shaped winding frame collars 15*b* provided at both edges thereof. A collar-shaped reinforcing member 16 is provided at the central portion of the winding frame drum 15*a*. The winding frame collars 15 and the reinforcing member 16 are welded to the winding frame drum 15*a* or integrally formed. The winding frame drum in the second embodiment is composed of aluminum alloy A5056B, while the winding frame collars 15*b* and the reinforcing member 16 are composed of aluminum alloy A5052 (JIS).

The winding frame 15 accordance to this embodiment includes the reinforcing member 16 provided at the central portion of the winding frame drum 15*a*, whereby the rigidity of the winding frame drum 15*a* can be enhanced. Further, the reinforcing member 16 is formed of substantially the same material as that of the winding frame drum 15*a* exhibiting a larger thermal expansion rate and a larger thermal contraction rate than those of the winding wire portion 4 (not shown). Therefore, a rise-and-fall duration of the temperature the reinforcing member 16 largely expands and contracts together with the winding frame drum 15*a*, and a contact surface pressure $\sigma_r$ or between the winding frame drum 15*a* and the winding wire portion 4 can be reduced. The superconducting coil in this embodiment is thereby stabilized with a higher quench current than in the conventional superconducting solenoid coil.

As discussed above, the principal point of the present invention is to reduce the contact surface pressure between the winding frame drum and the winding wire portion. The contact surface pressure can be, however, reduced indirectly by managing a strain of the winding frame drum when a rated current flows.

FIG. 9 is a graph showing a comparison between the superconducting coil of the present invention and the conventional superconducting coil in terms of the strain of the winding frame drum when the rated current flows. In the graph of FIG. 9, the axis of abscissas indicates a current I, while the axis of ordinates indicates a strain $\epsilon\theta$ of the winding frame drum. It is assumed that the strain $\epsilon\theta$ of the winding frame drum be a measured value of the maximum strain in such an arrangement that strain gauges are attached to a plurality of portions on an internal peripheral surface of the winding frame drum, and the strain gauge measures the maximum strain in the circumferential direction ($\theta$-direction) when the current I rises.

Reducing the contact surface pressure or between the winding wire portion and the winding frame drum implies a reduction in terms of a compression of the winding frame drum inward in the radial direction. When a compression force decreases, the strain $\epsilon\theta$ of the winding frame drum when rasing the current I is reduced. That is, restraining the winding frame drum strain $\epsilon\theta$ when the rated current flows down to a predetermined value or under is equivalent to a reduction in the contact surface pressure or between the winding wire portion and the winding frame drum.

Based on the above-mentioned, the superconducting coil in the second embodiment is constructed to arrange a material or rigidity of the winding frame. A winding tensile force or the superconducting wire and a method of the heat treatment so that the strain $\epsilon\theta$ when the current I rises up to a rated value is set on the order of $20\times10^{-6}$ or under. In the superconducting coil in accordance with the second embodiment wherein the winding frame drum strain $\epsilon\theta$ when the rated current flows is restrained down to the predetermined value or smaller, it is recognized that the quench current is stabilized high.

The present invention is not limited to the respective embodiments discussed above without departing from the gist of the present invention. Namely, the winding frame drum and the winding frame collar do not necessarily take the cylindrical or annular shape but may be formed in, e.g., a racetrack shape and a D-like shape. Further, a self-fusion enamel coated superconducting wire may be used in place of the enamel-coated superconducting wire, and the use of the bonding resin can be thus omitted. Moreover, a polyimide adhesive tape or a prepreg glass tape is employed as a substitute for the enamel, and the use of the bonding resin can be thus omitted. Further, the outer peripheral surface of the insulation-to-earth material is polished beforehand, and the polished smooth surface, it can be considered, serves as a frictional heat restraining material.

As apparent from the discussion given above, the superconducting coil according to the present invention includes the winding frame composed of a material, wherein its modulus of longitudinal elasticity is on the order of 50 (GPa) or larger, and its heat contraction rate between the room temperature and the temperature of 77 (K) is 0.35% or above. Hence, the heat expansion rate and the heat contraction rate of the winding frame are greater than whole of the winding wire portion, and the winding frame drum is capable of expanding the inside of the winding wire portion through the heat treatment.

In addition, when employing the superconducting coil, the temperature decreases down to an extremely low temperature, and the winding frame drum shrinks and is therefore capable of further reducing the contact surface pressure with the winding wire portion and the drum itself.

When using the superconducting coil, it is thereby possible to provide the superconducting coil having reduced (substantially zero) contact surface pressure between the winding wire portion and the winding frame drum and also effectively preventing the transition of the superconducting coil to the normal conductive state due to the frictional heat.

(Embodiment 3)

An embodiment 3 will be described with reference FIGS. 10 through 16.

FIG. 10 is a partial sectional view illustrating a winding wire portion 20 constructed in accordance with the embodiment 3. The winding wire portion 20 is constructed in such a way that the winding wire potion 20 is wound with fusion superconducting wires 23 in a plurality of lines and in a plurality of layers and reverts, after undergoing the heat treatment in a fastened state as will be stated later, to the room temperature. An internal layer close to a winding frame drum 2*a* (not shown, refer to FIG. 1) is shown in a lower part of the Figure, while an external layer apart from the winding frame drum 2*a* is shown in an upper part thereof. A vertical direction in the Figure corresponds to a layerwise direction, while a lateral direction corresponds to a linewise direction. FIG. 10 illustrates an inter-layers spacing 24 and an inter-line spacing 25. The fusion superconducting wire 23 consists of an insulated superconducting wire 21 and a fusion material 22.

The insulated superconducting wire 21 is composed of a superconducting wire 21*a* assuming a straight-angled shape in section and an insulating material 21*b*, for covering this wire 21*a*, having a substantially uniform thickness. The insulating material 21*b* is formed of, e.g., a formal resin or a polyimide tape. The fusion material 22 is composed of, e.g., a phenoxy resin, an epoxy resin in a half-hardened state or a hot-melt adhesive. This fusion material 22 is, as will be mentioned later, covered on the insulated superconducting wire 21. The fusion material 22 is brought into a solidified state by making it revert to the room temperature after being melted by the heat treatment posterior to the winding process or by the hardening action. Accordingly, the adjacent fusion superconducting wires 23 are bonded to each other by the fusion material 22.

The superconducting wire 21*a* has curved-surfaces 21*c* formed with round surfaces at four corners thereof in cross section, and other surfaces are formed as flat surfaces 21*d* on the side of the inter-layers spacing 24 and flat surfaces 21*e* on the side of the inter-lines spacing 25. The curved-surface 21*c*, the flat surface 21*d* and the flat surface 21*e* are roughly formed. Such roughly formed surfaces provide a more improved bonding property between the superconducting wire 21*a* and the insulating material 21*b* than on the smooth surface. Hollows are formed between the angular portions of the adjacent insulation superconducting wires 21 because of the existences of the curved surfaces 21*c*. Those hollows are not all filled with the fusion materials 22, however, the initial thickness of the fusion material 22 for covering the insulated superconducting wire 21 is adjusted so that some of those hollows are left in the form of cavities 26 (see FIG. 12). Because of existences of the cavities 26, the fusion materials contiguous thereto are capable of easily shrinking or expanding. The fusion materials 11 each having a thickness of 100 μm or under fill between the flat surfaces 21*d* on the side of the inter-layers spacing 24. The fusion material 22 is, as will be stated later, formed beforehand, and the winding wire portion 20 is fastened as will be explained later, Hence, the fusion material 22 does not exist between the flat surfaces 21*a* on the side of the inter-lines spacing 25.

The fusion superconducting wires 23 are wound in the intermediate through external layers by the winding tensile force 1.1–1.5 times as large as that in the internal layer. Accordingly, the fusion superconducting wires 23 are wound in the internal layer by the relatively smaller winding tensile force than that in the external layer, and, therefore, a spread in the radial direction is easy to attain. Besides, the winding wire portion 20 is, as will be described later, fixed in such a state as to fastening in the axial direction (linewise direction), and hence the internal layer of the fusion superconducting wires 23 expand in the radial direction.

FIG. 11 is an enlarged sectional view illustrating the cavity 26 of FIG. 10 and elements in the vicinity thereof. The temperature for the heat treatment is set so that a viscosity of the fusion material 22 when melted is as small as 0.5–5 $Nsm^{-2}$. For this reason, the fusion materials 22 are collected in a narrow space between the curved surfaces 21*c* by dint of a capillary phenomenon and then solidified. Concomitantly with this solidification, an angular area 26*a* of the cavity 26 is rounded. The rounded but angular area 26*a* exhibits a smaller stress than in an angular area having an acute angle.

FIG. 12 is a cross sectional view showing a fusion superconducting wire 23*a* before applying the heat treatment. An outer peripheral portion of the fusion superconducting wire 23*a* is finished with a dimensional accuracy on the order of ±10 μm by forming the fusion material 22 as will be stated later. The fusion materials 22 are covered on the insulating materials 21*b* located on the curved surfaces 21*c* and on the flat surfaces 21*d* of the insulated superconducting wire 21. The insulating material 21*b* located on the flat surface 23*e* is, however, covered with a thin fusion material 22, or no fusion material.

FIG. 13 is a cross sectional view illustrating a structure of a fusion superconducting wire 23*b* before being formed. At this stage, a fusion material 22*b* is covered on the insulating material 21*b* with a substantially uniform thickness.

FIG. 14 is a partial perspective view illustrating the fusion superconducting wire and a forming apparatus thereof. This forming apparatus includes plural pairs of heating rollers 30 each rotating in a direction with an arrow P. Forming portions 30*a* of the heating rollers 30 are shaped in conformity with configurations of the curved surface 5*c* and the flat surface 5*e* of the fusion superconducting wire 23*a* of FIG. 12. Further, the forming portion 30*a* is heated at a temperature enough to soften the fusion material 22*b*, and the curved surface 5c and the flat surface 5e are pushed down through the fusion material 22b. The heating rollers 30 make the fusion superconducting wire 23 in a direction with an arrow Q in the Figure with their rotations and thus form a fusion superconducting wire 23b assuming a state of FIG. 13 into a fusion superconducting wire 23a assuming a state of FIG. 12.

FIG. 15 illustrates a fastening apparatus 40 for fastening the fusion superconducting coil and for use with the heat treatment. The fusion superconducting coil is put into an unillustrated heating furnace in such a state as to be set in this fastening apparatus before the heat treatment. An internal temperature of the heating furnace, i.e., a heat treatment temperature is set at 100°–250° C., and the winding wire portion 20 of the fusion superconducting coil undergoes the heat treatment at this temperature. An upper winding frame collar 2c, a winding frame drum 2a and a lower winding frame collar 2b of the fusion superconducting coil are separably constructed. The upper winding frame collar 2c is movable coaxially down ward with respect to the winding frame drum 2a and the lower winding frame collar 2b as well. The fastening apparatus comprises mainly comprises a pedestal member 41 and a winding frame reinforcing member 43 located in the central hole of the winding frame drum 2a and acting as a member for reinforcing the winding frame when fastening with respect to the winding wire portion 30. The fastening apparatus also comprises a presser member 43 for pressing the winding wire portion 20 through the upper winding frame collar 2b in the axial direction as indicated by an arrow R.

The presser member 43 is pressed down by an unillustrated pressing apparatus. Herein, the winding wire portion 20 is pressed in the axial direction, whereby the fastening force acts in a direction substantially perpendicular to the winding direction of the fusion superconducting wire 23. The winding frame reinforcing member 42 is pushed against the inside of the winding frame drum 1a before winding the fusion superconducting wire 23 and acts so as not cause inward deformations of the winding frame drum 2a and of the winding wire portion 20. Further, the winding frame reinforcing member 42 is composed of a material exhibiting a larger thermal expansion coefficient than the winding wire portion 20, i.e., the same material, e.g., aluminum alloy as the winding frame 2. Therefore, the winding frame reinforcing member 42 and the winding frame drum 2a act to expand the internal layer of the winding wire portion 20 in the radial direction when pressed by the presser member 41. The lower winding frame collar 2b is fixed to the pedestal member 41. A terminal 44 of the winding wire portion 20 is led from the lower winding frame collar 2b and inserted into a hole 45 formed in the pedestal member 41.

After the fusion material has been heated in such a state as to fasten the winding wire portion 20, thus softened and then reverted to the room temperature in the manner as described above, the fastening apparatus is detached from the winding wire portion 20. Thereupon, the internal layer of the winding wire portion 20 is solidified in such a state as to expand in the radial direction, and, hence, an area between the winding wire portion 20 and the winding frame drum 2a comes into a substantially afloat state. When cooled down to an extremely low temperature to make the coil function as the superconducting coil, the area between the winding wire portion 20 and the winding frame drum 2a is completely afloat due to a difference in terms of the thermal expansion coefficient therebetween. Besides, the fusion material 22 is not covered on the flat surface 5e on the side of the inter-lines spacing 25 (see FIG. 10), while the winding wire portion 20 is solidified in such a state as to be pressed in the axial direction. Hence, a rigidity of the winding wire portion 20 in the axial direction (linewise direction) increases.

FIG. 16 shows results of measuring quench currents Iq of the fusion superconducting coil according to the present invention as shown in FIG. 10 and of the fusion superconducting coil in the prior art as shown in FIG. 2. It can be recognized that the fusion superconducting coil of the present invention has a larger value of the quench current Iq than in the prior art.

(Embodiment 4)

FIG. 17 is a view of assistance in explaining a method of processing a fusion superconducting wire 27 in an embodiment 4 of the present invention. The fusion material 22 is covered on an entire outer peripheral surface of an insulated superconducting wire 21 at an initial stage as shown in FIG. 17 in this embodiment. At first, sands 28 are blown against the line-directional flat surface and curved surfaces 21c from on one direction as indicated by arrows S, thereby removing the fusion material 22 on the curved surfaces 5c and the flat surface 21e on one side. Thereafter, the sands 20 are blown from the side opposite to the arrows S, thereby removing the fusion material 22 on the curved surface 21c and the flat surface 21e on the opposite side. The fusion superconducting wire 27 in which the fusion material 22 is eliminated from the flat surfaces on both sides is used as a substitute for the fusion superconducting wire 23a. Thereafter, the processing is conducted pursuant to the case of the embodiment 1. The same operation and effect as those in the embodiment 3 can be obtained in this embodiment 4.

(Embodiment 5)

FIG. 18 illustrates a fusion superconducting wire 31 in an embodiment 3. A band-like fusion material 22 is press-fitted to an area extending from the curved surface 5c to the flat surface 21d of the insulated superconducting wire 21 by the heating rollers. Even when the fusion superconducting wire 31 having the fusion material 32 press-fitted that way is employed as a substitute for the fusion superconducting wire 23a of FIG. 12, the same operation and effect as those in the embodiment 3 or the embodiment 4 can be obtained.

(Embodiment 6)

FIGS. 19 and 20 illustrate a fusion superconducting wire in an embodiment 6. FIG. 19 shows a sectional structure of a fusion superconducting wire 33a after being formed. FIG. 20 illustrates a fusion superconducting wire 33b before being formed. Referring to FIG. 19, the outer periphery of the curved surface 21c of the fusion superconducting wire 33a is finished with a dimensional accuracy on The order of ±10 μm by sue of a formed fusion material 34a. The fusion material 34a is formed on only the curved surface 21c of the insulated superconducting wire 21 but is not formed on the flat surfaces 21d, 21e.

FIG. 20 shows a fusion superconducting wire 34b before being formed. A string-like fusion material 34b is pressed-fitted to the curved surface 21c of the insulated superconducting wire 21 by the heating rollers. The fusion material 34b is formed such that the epoxy resin impregnates a thread of glass fibers or aramide fibers and is then half-hardened. Alternatively, the fusion material 34b may also be such that a welted phenoxy resin or a hot-melt bonding agent is extruded from a nozzle and solidified on the curved surface 21c. When the fusion material 34b is formed by the heating rollers, the fusion superconducting wire 33b turns out a fusion superconducting wire 33*a*. Even when the fusion superconducting wire 33*a* is employed in place of the fusion superconducting wire 23*a* of FIG. 12, the same operation and effect as Those in the embodiment 1 can be obtained. Besides, the fusion material 24*b* is formed on neither the flat surface 21*e* nor the flat surface 21*d*, and, therefore, the rigidity of the solidified winding wire portion is also enhanced in the layerwise direction as well as in the linewise direction.

(Embodiment 7)

FIGS. 21 and 22 illustrate a fusion superconducting wire in accordance with an embodiment 7 of the present invention. FIG. 21 depicts a sectional structure of a winding wire portion 50. FIG. 22 illustrates a sectional structure of a fusion superconducting wire 51*a* before applying the heat treatment. The winding wire portion 50 of FIG. 12 is constructed such that fusion superconducting wires 51 are wound in a plurality of lines and in a plurality of layers and, after undergoing the heat treatment in the fastened state, reverts to the room temperature. An internal layer vicinal to the unillustrated winding frame drum 2*a* is shown in a lower part of the Figure, while an external layer apart from the winding frame drum 2*a* is shown in an upper part thereof. A vertical direction in the Figure corresponds to a layerwise direction, while a lateral direction corresponds to a linewise direction. Shown also in the Figure are an inter-layer spacing 54 and an inter-line spacing 55. The fusion superconducting wire 51 consists of an insulated superconducting wire 52 and a fusion material 53. The adjacent fusion superconducting wires 26 are bonded to each other by a fusion material 53. The insulated superconducting wire 52 is composed of a superconducting wire 52*a* and an insulating material 52*b*, and the insulating material 52*b* is covered on the superconducting wire 52*a* with an uniform thickness.

This superconducting wire 52*a* takes a circular shape in section, and all the surfaces of the superconducting wire 29*a* are curved surfaces 52*c*. A thickness of the fusion material 53 is adjusted so that an area between the curved surfaces 52*c* is not all filled with the fusion material 53, and, after performing the heat treatment for the fusion material 53, a cavity 56 is resultantly formed between the insulation superconducting wires 52. With this arrangement, the fusion material 53 contiguous to the cavity 56 is capable of easily contracting and expanding. The fusion materials 53 are collected in a narrow space between the curved surfaces 52*c* by dint of the capillary phenomenon and then solidified. Concomitantly with this solidification, an angular area of the cavity 56 is rounded. The rounded but angular area exhibits a smaller stress than in an angular area having an acute angle.

FIG. 22 illustrates the fusion superconducting wire 51*a* before applying the heat treatment. The fusion superconducting wire 51*a* is constructed such that the fusion material 30 is, as shown in FIG. 22, covered on the insulating material 52*b* with a uniform thickness. Thus, the insulation superconducting wires 52 are contiguous to each other at the inter-line spacing 55, and hence a rigidity of the winding wire portion 50 in the linewise direction is higher than in a non-contiguous state. Even when the superconducting wire 52*a* assumes a circular shape in section, the angular area of the cavity 56 is still round.

(Embodiment 8)

An embodiment other than the embodiments discussed above will be described with the aid of the already-referred drawings.

The operation and the effect that are similar to those in the embodiment 3 can be obtained even if the fusion material 22 f FIG. 10 is previously integrally formed. Manufactured is, e.g., a tape including a tape-like base material made by weaving the glass fibers and impregnated with the phenoxy resin. This tape is covered on the superconducting wire 21*a*, the fusion superconducting wire can be thus formed. Manufactured alternatively is a tape in which double sides of a polyimide tape is coated with the phenoxy resin. This tape is covered on the superconducting wire 21*a*, and the fusion superconducting wire can be thus formed. Even when the superconducting wire 21*a* is formed as a forcible cooling conductor, the operation and the effect that are similar to those in the embodiment 1 can be obtained. If a mold releasing material having a low frictional coefficient is interposed between the winding wire portion 20 and the winding frame drum 2*a*, it is possible to reduce an exothermic quantity concomitant with an exfoliation or the friction between the winding wire portion 20 and the winding frame drum 1*a*.

(Embodiment 9)

In the above embodiments inclusive of the embodiments 3–7, after the fusion superconducting wires have been wound in the plurality of lines and in the plurality of layers, the heat treatment is applied. Herein, however, the superconducting coil undergoing the heat treatment while being wound will be explained by way of an embodiment 9. The fusion material is not melted when wound by applying the heat treatment while being wound, and, therefore, the insulation superconducting wires are directly contiguous to each other at the inter-layer of the winding wire portion. For this reason, the rigidity of the winding wire portion in the layerwise direction becomes higher than in the non-contiguous state. Further, a displacement of the winding wire portion, which ensues from the heat treatment, can be reduced.

(Embodiment 10)

The above embodiments inclusive of the embodiment 7 have dealt with the fusion superconducting coil. Herein, however, a superconducting coil using no fusion material will be explained. The insulation superconducting wires are wound in the intermediate and external layers apart from the winding frame by a larger winding tensile force than in the internal layer close to the winding frame. When exciting the superconducting coil in this manner, an electromagnetic force causes the internal layer to expand in the radial direction and pushes the inter-layer. It is therefore possible to make a large friction and exfoliation of the inter-layer hard to occur.

As discussed above, in the fusion superconducting coil of the present invention, the fusion superconducting wires in the internal layer are expanded in the radial direction, and consequently the compression stress acts on the interlayer. This compression stress is also residual when a thermal stress and the electromagnetic force act on the inter-layer, so that the inter-layer is not largely exfoliated. The cavity is formed between the curved surfaces of the fusion superconducting wire, and the angular area of the cavity is rounded. Hence, the thermal stress acting on the fusion material is reduced, with the result that a large crack is not produced. The area between the winding wire portion and the winding frame drum is solidified as if being in the afloat state, and therefore the frictional heat becomes smaller than in the case of being solidified to keep a strongly contiguous state.

Further, since the winding wire portion is fastened and then solidified to enhance the rigidity, the large deformation is not caused by the electromagnetic force, resulting in no occurrence of the large friction between the winding wire portion and the drum insulation-to-earth material. Thus, the arrangement is such that the heat evolution concomitant with the exfoliation, the crack and the friction is restrained small, and the quench current of the fusion superconducting coil increases. Therefore, the large current is allowed to flow with a stability. Further, after the solidifying the winding wire portion, the fastening apparatus is demounted, and the fusion superconducting coil can be downsized. Further, the fastening apparatus can be repeatedly employed.

It is apparent that, in this invention, a wide range of different working modes can be formed based on the invention without deviating from the spirit and scope of the invention. This invention is not restricted by its specific working modes except being limited by the appended claims.

What is claimed is:

1. A superconducting coil comprising:

a winding frame composed of a material having a modulus of longitudinal elasticity that is 50 (GPa) or greater, and a thermal contraction rate that is 0.35% or above between a room temperature and 77 (K);

a superconducting wire covered with an insulating material; and a winding wire portion formed by winding an outer periphery of said winding frame with said superconducting wire while applying a tensile force thereto, wherein a bonding material is impregnated between portions of the winding wire portion and then solidified by a heat treatment, a contact surface pressure between said winding wire portion and said winding frame being reduced thereby, wherein said winding wire portion is formed by winding the outer periphery of said winding frame with said superconducting wire in a plurality of layers, and wherein a winding tensile force of said superconducting wire in an external layer area apart from said winding frame of said winding wire portion is set larger than a winding tensile force of said superconducting wire on an internal layer area close to said winding frame of said winding wire portion.

2. The superconducting coil according to claim 1, wherein said superconducting wire is coated with enamel, and a maximum temperature for the heat treatment is set higher than a glass transition temperature of the enamel.

3. The superconducting coil according to claim 1, wherein said winding frame is constructed of a drum and collar, and a relationship between a thickness d (mm) of said winding frame drum and a winding tensile force F(N) of said superconducting wire on the winding wire internal layer area close to said winding frame drum is set such that $d>F/10$.

4. The superconducting coil according to claim 1, wherein said winding frame is constructed of a drum and a collar, and a relationship between a thickness d(mm) and a length L(mm) of said winding frame drum is set such that $d>L/20$.

5. The superconducting coil according to claim 1, wherein said winding frame is constructed of a drum and a collar, said winding frame drum is provided with a reinforcing member, and said reinforcing member is composed of a material having a modulus of longitudinal elasticity that is 50 (GPa) or greater, and a thermal contraction rate that is 0.35% or above between a room temperature and 77 (K).

6. The superconducting coil according to claim 1, wherein said winding frame and said winding wire portion are constructed so that a strain of a winding frame drum when a current rises up to a rated value is set to $20\times10^{-6}$ or under.

* * * * *